US006064010A

United States Patent [19]

Bessede

[11] Patent Number: 6,064,010

[45] Date of Patent: May 16, 2000

[54] COMPOSITE INSULATOR END FITTING

[75] Inventor: Jean-Luc Bessede, Chateauvillain, France

[73] Assignee: GEC Alsthom T & D SA, Paris, France

[21] Appl. No.: 09/102,656

[22] Filed: Jun. 23, 1998

[30] Foreign Application Priority Data

Jun. 26, 1997 [FR] France ..... 97 08009

[51] Int. Cl.[7] ..... H01B 17/00; H01B 17/16; H01B 17/38

[52] U.S. Cl. ..... 174/176; 174/178; 174/183; 174/209

[58] Field of Search ..... 174/176, 178, 174/183, 186, 188, 191, 209, 168

[56] References Cited

U.S. PATENT DOCUMENTS

| | | | |
|---|---|---|---|
| 3,698,749 | 10/1972 | Yonkers | 287/20.3 |
| 4,005,297 | 1/1977 | Cleaveland | 200/144 B |
| 4,190,736 | 2/1980 | Warnet et al. | 174/209 |
| 4,281,943 | 8/1981 | Viennot | 403/267 |
| 4,956,525 | 9/1990 | Wilk | 174/152 R |
| 5,977,487 | 11/1999 | Kuhl | 174/176 |
| 5,985,087 | 11/1999 | Karl et al. | 156/293 |

FOREIGN PATENT DOCUMENTS

| | | |
|---|---|---|
| 2069424 | 9/1971 | France . |
| 2357993 | 2/1978 | France . |
| 1092976 | 11/1960 | Germany . |
| 8-36925 | 2/1996 | Japan . |
| 8-36927 | 2/1996 | Japan . |

*Primary Examiner*—Kristine Kincaid
*Assistant Examiner*—Mark Olds
*Attorney, Agent, or Firm*—Sughrue, Mion, Zinn Macpeak & Seas, PLLC

[57] ABSTRACT

An end fitting having a bore that forms a sleeve for the shank of an electrical insulator of composite structure. The bore has a substantially frustoconical wall that flares away from the bore opening towards the end wall of the bore and has an annular swelling directed towards the inside of the bore. This complex shape for the wall of the bore contributes to reinforcing the strength of the fixing between the end fitting and the shank by interference due to heat shrinking.

8 Claims, 1 Drawing Sheet

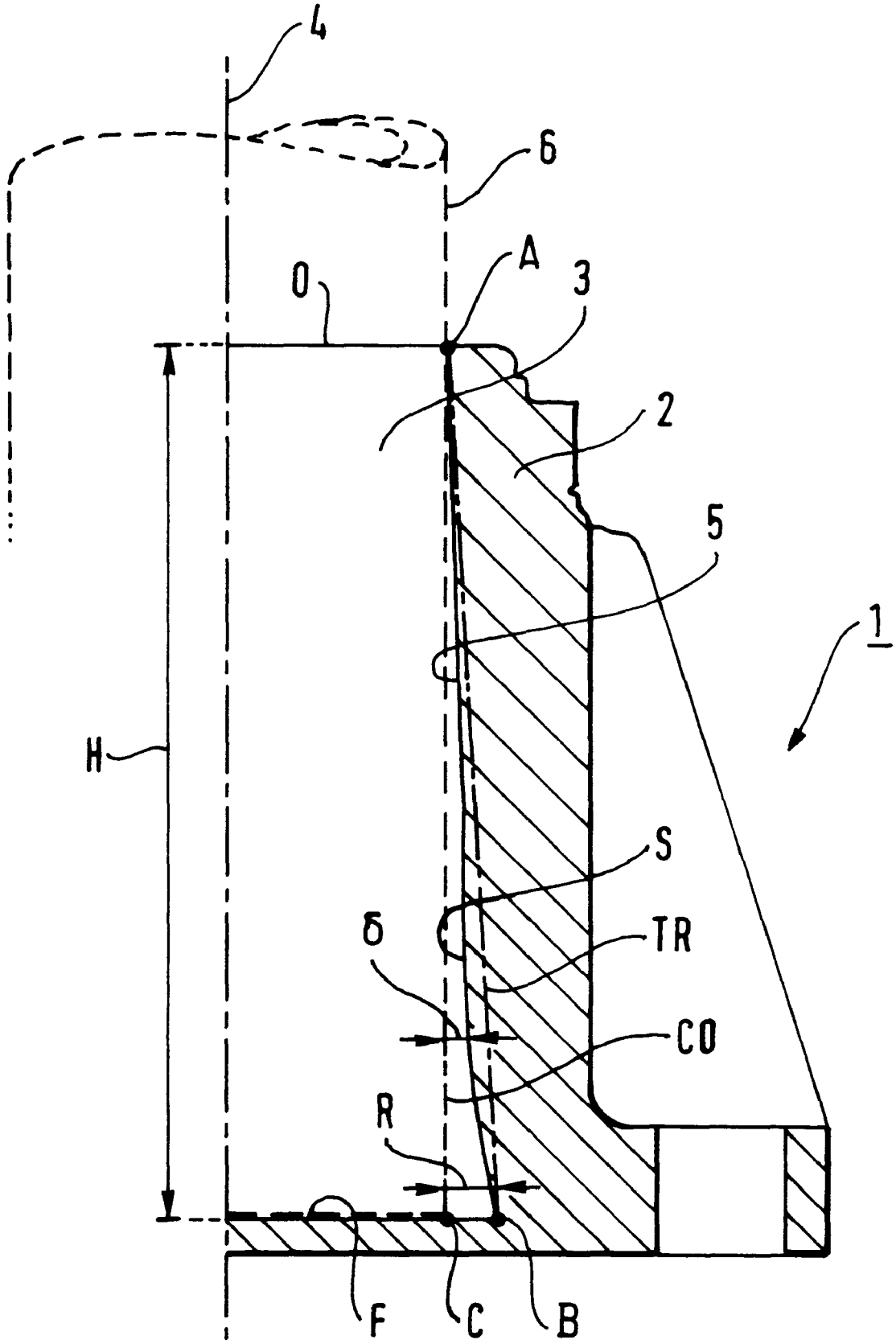
4
6
A
3
O
2
5
1
H
S
TR
CO
R
F
C
B

COMPOSITE INSULATOR END FITTING

The invention relates to fixing end fittings on the ends of a tube of composite material (glass fibers and epoxy) and more particularly on the ends of a hollow shank of an electrical insulator of composite structure. Such an end fitting comprises a metal body, e.g. of aluminium alloy, having a bore of generally cylindrical shape constituting a sleeve in which an end of the shank of the electrical insulator is inserted and stuck. It serves as anchor means for the electrical insulator.

BACKGROUND OF THE INVENTION

It has been observed that with insulators of this kind, when they are used at relatively high temperatures, e.g. above 60° C., the adhesive or the resin which is used for fixing the end fitting to the end of the shank suffers creep and loses its mechanical characteristics, in particular its traction strength. Consequently, the end fitting can become separated from the shank of the insulator and can be projected at high speed, which is dangerous.

The problem of security in the fixing between an end fitting and an insulator support has already been raised in the prior art, but for insulators for which the support is a solid bar rather than a hollow shank as mentioned above. This has led to end fittings being designed having a bore that is frustoconical in shape, as disclosed in Japanese patent documents Nos. JP 80/36925 and JP 80/36927.

OBJECT AND SUMMARY OF THE INVENTION

The object of the invention is to provide a solution for obtaining improved fixing between an endpiece and a hollow shank of an electrical insulator, in particular a fixing that does not run any risk of coming apart when the insulator is used at temperatures exceeding 60° C.

To this end, the invention provides an end fitting for an electrical insulator of composite structure having a hollow shank, the end fitting comprising a body having a bore forming a sleeve for the shank of the electrical insulator, and wherein said bore has a substantially frustoconical wall that flares away from the opening towards the end wall of the bore and that has an annular swelling directed towards the inside of the bore.

Preferably, the end fitting is secured to the end of the shank of the insulator by heat shrinking. Fixing of the end fitting on the end of the shank is preferably reinforced by means of adhesive.

BRIEF DESCRIPTION OF THE DRAWING

An embodiment of the invention is described below in detail with reference to the sole FIGURE which is a fragmentary longitudinal section through an end fitting of the invention fixed on the end of a shank of a composite insulator.

MORE DETAILED DESCRIPTION

In the FIGURE, the end fitting 1 is shown in longitudinal axis half-section. The end fitting is designed to be fixed to one end of a hollow shank made of composite material of a composite electrical insulator. It comprises a metal body 2, e.g. made of aluminum alloy, in which a bore 3 is machined. The bore 3 forms a sleeve designed to receive the end of the shank which extends along the longitudinal axis 4 of the shank.

The bore 3 has a wall 5 that is substantially frustoconical in shape, flaring away from the opening of the bore referenced as O towards the end wall of the bore referenced as F.

According to the invention, the wall 5 also has an annular swelling directed towards the inside of the bore. As shown in the FIGURE, the complex surface of the wall 5 of the bore lies between an accurately frustoconical surface TR defined by a generator line passing through points A and B and a strictly cylindrical surface CO defined by a generator line passing through points A and C, said cylindrical surface correspond to the cylindrical outside surface of the shank 6 of the insulator.

Compared with a strictly cylindrical wall, the wall of the bore of the end fitting of the invention provides greater pull-out resistance because of its frustoconical shape. In addition, the annular swelling of the wall of the bore, compared with a strictly frustoconical wall, makes it possible to provide an assembly with less stress and to obtain better distribution of stresses over the entire area of the interface between the shank and the end fitting.

The complex surface of the wall of the bore 3 is determined using a method of computation by finite elements. Such a method is implemented, for example, in the "ANSYS" version 5.2 software sold by ANSYS Inc. With that software, a first model is made of stress-free contact between a model metal ring mounted on the bottom portion of a model tube having the mechanical characteristics of the shank of the insulator. The temperatures given to the ring (T1) and to the tube (T2) are different and correspond to the temperatures used during the operation of heat shrinking the end fitting on the shank of the insulator. In particular, T1 is greater than 60° C. and T2 is less than or equal to ambient temperature. By calculation, the temperature of both parts is brought to a temperature T3 that is at least as great as the temperature of use of the insulator concerned. Since the temperature T3 is lower than the temperature T1, the model ring tightens onto the model tube, thereby giving rise to a certain amount of deformation in the bottom portion thereof. The shape taken up by the bottom portion of the model tube is then used to define, in a model, the swollen frustoconical surface required for the bore of the end fitting such that at any temperature lower than or equal to T3, there exists compression stress at the interface between the tube and the end fitting, which stress is distributed along said interface.

It can be observed that this complex surface for the bore of the end fitting satisfies the following characteristics, given with reference to the figure:

- the offset $\delta$ between the surface CO and the surface S of the wall of the bore 3 increases in non-linear manner on going away from point A towards point B; and
- the point A is set back relative to the point B away from the axis 4 by an amount R which depends on the height H of the bore and satisfies the relationship $0.2\% < R/H < 20\%$.

A composite electrical insulator having an end fitting of the invention is made as follows. The hollow shank is made, for example, by a known technique of winding resin-impregnated glass fiber filaments. The filament winding is sliced and the ends of a slice are machined to obtain insulator shanks 6 having ends of specified outside diameter. Each end fitting is made by casting, machining, or the like so as to have a bore 3 with a swollen complex surface as described above, with the opening of the bore nevertheless being of a size so as to have a diameter that is perceptibly smaller than the outside diameter of the end of the shank on which the end fitting is to be fixed.

The end fitting is heated until the opening of the bore thereof has expanded sufficiently to enable the end of the shank to be inserted therein. Before being inserted into the end fitting, the end of the shank is covered in adhesive. On cooling to ambient temperature, the end fitting tightens around the end of the shank. The end fitting is therefore heat-shrunk onto the shank by thermal contraction.

In a variant, it is possible to provide for thermal contraction of the shank of the insulator prior to inserting it into the end fitting, e.g. by dipping it into liquid nitrogen. It is also possible to combine thermal contraction of the shank of the insulator with thermal expansion of the bore of the end fitting before they are assembled together.

As mentioned above, uniform distribution of stresses along the interface between the shank and the end fitting is obtained and only a fine layer of adhesive remains in said interface, thereby contributing to limiting shear stresses in the adhesive.

What is claimed is:

1. An end fitting for an electrical insulator of composite structure having a hollow shank of a first diameter, the end fitting comprising a body having a bore centered on an axis, wherein the bore comprises an opening, an end wall, and a substantially frustoconical sidewall to form a sleeve for the shank of the electrical insulator, and wherein the opening is of a second diameter that is smaller than the first diameter, and wherein the substantially frustoconical sidewall flares away from the opening towards the end wall of the bore, the substantially frustoconical sidewall further comprises an annular swelling directed towards the interior of the bore, wherein an offset between the annular swelling and the axis increases non-linearly in a direction proceeding from the opening towards the end wall.

2. The end fitting according to claim 1, wherein the end fitting is engaged as an interference fit on the shank by heat shrinking.

3. The end fitting according to claim 1, wherein the end fitting is engaged to the shank by adhesive.

4. The end fitting according to claim 1, wherein the end fitting has a first expansion temperature and the shank has a second expansion temperature, and the first expansion temperature is less than the second expansion temperature.

5. The end fitting according to claim 1, wherein the depth of the bore and the diameter of the bore at the end wall defines a relation as follows, $$0.2\% < R/H < 20\%,$$

wherein H is the depth of the bore,

R is the radius of the bore, measured at the end wall, from the axis to the substantially frustoconical sidewall, less the radius of the bore, measured at the opening, from the axis to the substantially frustoconical sidewall.

6. The end fitting according to claim 1, wherein the end fitting remains engaged to the shank above temperatures of about 60° C.

7. The end fitting according to claim 1, wherein the body is formed from metal.

8. The end fitting according to claim 7, wherein the body comprises aluminum alloy.

* * * * *